US008990983B2

(12) United States Patent
Clenet et al.

(10) Patent No.: US 8,990,983 B2
(45) Date of Patent: Mar. 31, 2015

(54) BED FRAME FOR AN ADJUSTABLE BED

(75) Inventors: Alain Clenet, Santa Ynez, CA (US); Joseph Ermalovich, Santa Barbara, CA (US)

(73) Assignee: Ergomotion, Inc., Santa Barbara, CA (US)

( * ) Notice: Subject to any disclaimer, the term of this patent is extended or adjusted under 35 U.S.C. 154(b) by 452 days.

(21) Appl. No.: 12/942,916

(22) Filed: Nov. 9, 2010

(65) Prior Publication Data

US 2011/0247138 A1 Oct. 13, 2011

Related U.S. Application Data

(60) Provisional application No. 61/323,095, filed on Apr. 12, 2010.

(51) Int. Cl.

| | |
|---|---|
| ***A47B 7/00*** | (2006.01) |
| ***A47C 20/04*** | (2006.01) |
| ***A47C 19/02*** | (2006.01) |

(52) U.S. Cl.

CPC ..... *A47C 20/04* (2013.01); *A47C 19/021* (2013.01)

USPC ..... 5/613; 5/617; 5/618; 5/619; 5/249; 5/250

(58) Field of Classification Search

CPC ..... A61G 7/015; A61G 7/012; A61G 7/16; A61G 7/002; A61G 13/1285; A61G 1/013; A61G 1/017; A61G 2007/0518; A61G 7/0525; A47C 20/08; A47C 20/04; A47C 23/067; A61H 2201/0142

USPC ..... 5/613, 617–619, 249–251

See application file for complete search history.

(56) References Cited

U.S. PATENT DOCUMENTS

| | | | | |
|---|---|---|---|---|
| 4,685,160 A | | 8/1987 | Rizzardo | |
| 5,105,487 A | | 4/1992 | Hakamiun et al. | |
| 5,279,010 A | * | 1/1994 | Ferrand et al. | 5/600 |
| 5,421,046 A | * | 6/1995 | Vande Streek | 5/624 |
| 5,537,701 A | * | 7/1996 | Elliott | 5/617 |
| 5,544,376 A | * | 8/1996 | Fromson | 5/618 |
| 5,969,488 A | | 10/1999 | Fromson | |

(Continued)

FOREIGN PATENT DOCUMENTS

| | | |
|---|---|---|
| AU | 1664283 A | 1/1985 |
| CH | 547620 A | 4/1974 |

(Continued)

*Primary Examiner* — Robert G Santos
*Assistant Examiner* — Duoni Pan
(74) *Attorney, Agent, or Firm* — Felix L. Fischer

(57) ABSTRACT

A bed frame with a support structure has a rigid structural frame for carrying an articulating structure for an adjustable bed. The support structure extends substantially to the extents of the articulating structure in an unarticulated position and has a padded bolster. The bolster incorporates a mounting support attached to the structural frame and a resilient foam bumper received on the mounting support with a fabric covering surrounding the bumper and fastened to the mounting support. The articulating structure includes rigid planar supports having edges with a surrounding resilient foam layer having a fabric covering secured to the planar support. The bumper and foam layer are resilient to deform upon contact with an intruding appendage inserted between them. For an exemplary embodiment, an electrical outlet is mounted in a housing which penetrates the support frame, mounting support and bumper.

16 Claims, 19 Drawing Sheets

(56) References Cited

U.S. PATENT DOCUMENTS

| | | | | |
|---|---|---|---|---|
| 6,006,379 | A * | 12/1999 | Hensley | 5/618 |
| 6,061,852 | A * | 5/2000 | Bathrick et al. | 5/618 |
| 6,889,396 | B2 * | 5/2005 | Weinman | 5/411 |
| 6,928,673 | B2 * | 8/2005 | Risk, Jr. | 5/425 |
| 6,951,037 | B2 * | 10/2005 | Weinman et al. | 5/618 |
| 7,047,579 | B2 * | 5/2006 | Piana et al. | 5/411 |
| 8,069,514 | B2 * | 12/2011 | Poulos et al. | 5/618 |
| 2003/0093862 | A1 * | 5/2003 | Hanson et al. | 5/613 |
| 2005/0210587 | A1 | 9/2005 | Piana et al. | |
| 2008/0276373 | A1 | 11/2008 | Clenet | |
| 2009/0089930 | A1 * | 4/2009 | Benzo et al. | 5/613 |

FOREIGN PATENT DOCUMENTS

| | | | |
|---|---|---|---|
| DE | 2652998 | A1 | 5/1978 |
| EP | 1101481 | A2 | 5/2001 |
| EP | 1428459 | A1 | 6/2004 |

* cited by examiner

BED FRAME FOR AN ADJUSTABLE BED

REFERENCE TO RELATED APPLICATIONS

This application claims priority of U.S. Provisional Patent Application Ser. No. 61/323,095 filed on Apr. 12, 2010 having the same title as the present application. This application is copending with U.S. patent application Ser. No. 12/154,509 filed on May 23, 2008 entitled ADJUSTABLE BED FRAME ASSEMBLY and Ser. No. 12/367,538 filed on Feb. 8, 2009 entitled ARTICULATING BED SYSTEM both having a common assignee with the present invention, the disclosures of which are incorporated herein by reference.

BACKGROUND

1. Field

This invention relates generally to the field of adjustable beds and more particularly to a structure employing a flexible strap extending laterally and outwardly from under the mattress to encircle the mattress foot for maintaining the position of a mattress on an articulating bed during actuation of the bed and at the various articulated positions of the bed.

2. Description of the Related Art

Articulating beds have long been used in hospital and healthcare facilities to allow positioning of a patient in a reclining position, sitting position, elevated leg position or combinations of these positions. General usage of articulating beds has been rapidly expanding due to the comfort and convenience available from adjusting the bed to desired positions for reading, general relaxation or sleeping.

Development of the articulating or adjustable beds for personal or home use has been somewhat hampered by the requirements to camouflage or disguise the operating elements of the bed to provide an aesthetically pleasing appearance as a piece of furniture for use in a home. Additionally in the prior art, the nature of an articulating bed having a moving foot portion 2 as shown in FIGS. 1A and 1B for the flat (unarticulated) and articulated position (reproduced from FIGS. 3 and 7 of U.S. Pat. No. 6,826,793 to Tekulve issued Dec. 7, 2004), typically requires that the underlying support frame 4 be shortened by an offset 6 to avoid a trip or collision hazard when the foot portion is raised or articulated in a manner that would otherwise expose the extremity of the frame underlying the foot portion. Additionally, the portions of the frame which are exposed during articulation of the bed may pose a pinch hazard between the frame and articulated portion when returned to the unarticulated state.

It is therefore desirable to provide a bed frame for an articulating bed which provides a pleasing aesthetic appearance and provides protection to prevent collision injury and pinch hazards.

The size and weight of articulating adjustable beds is often an issue in installation of such beds, particularly in personal residences where entry ways may be of smaller size and tighter spacing.

It is therefore desirable to provide structure for the bed frame which may be separated for ease of installation.

SUMMARY

The embodiments disclosed herein overcome the shortcomings of the prior art by providing protective bed frame with a support structure having a rigid structural frame for carrying an articulating structure for an adjustable bed. The support structure extends substantially to the extents of the articulating structure in an unarticulated position and has a padded bolster. The bolster incorporates a mounting support and a resilient foam bumper received on the mounting support with a fabric covering surrounding the bumper and fastened to the mounting support. The mounting support is attached to the structural frame. The articulating structure includes rigid planar supports having edges and a resilient foam layer surrounding the edges of the planar supports with a fabric covering surrounding the foam layer and secured to the planar support. The bumper and foam layer are resilient to deform upon contact with an intruding appendage inserted between them. For an exemplary embodiment, an electrical outlet is mounted in a housing which penetrates the support frame, mounting support and bumper.

BRIEF DESCRIPTION OF THE DRAWINGS

These and other features and advantages of the present invention will be better understood by reference to the following detailed description of exemplary embodiments when considered in connection with the accompanying drawings wherein.

DETAILED DESCRIPTION

Figure 1A:
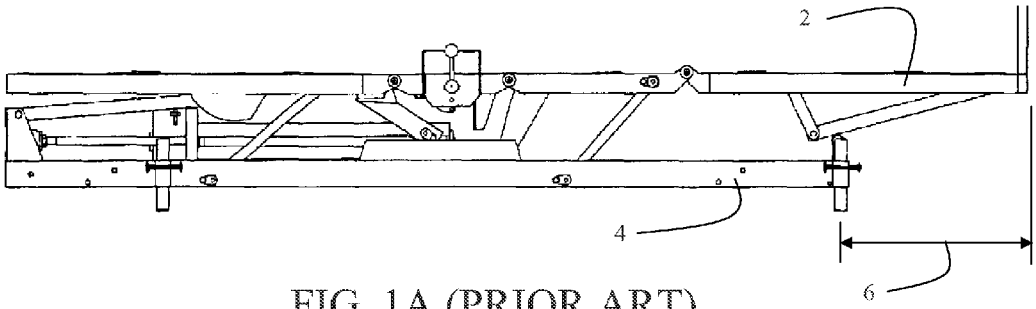
FIG. 1A (PRIOR ART)
FIGS. 1A and 1B are side views of a prior art frame system in the flat and articulated positions.
Figure 1B:
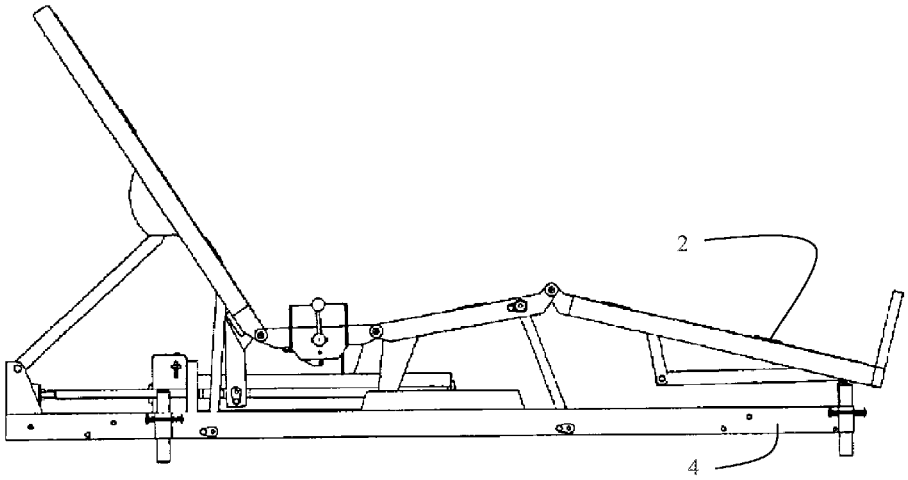
FIG. 1B (PRIOR ART)
Figure 2:
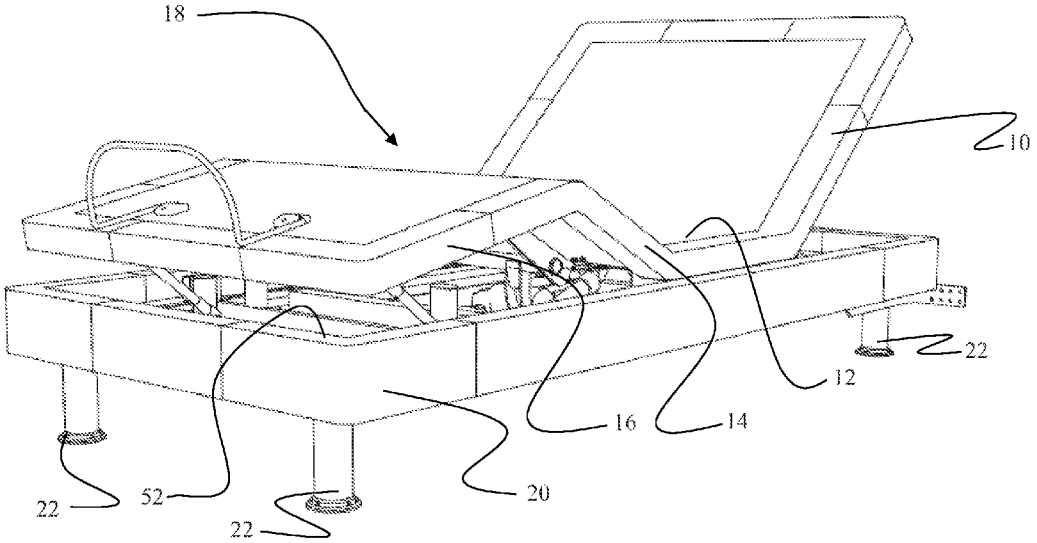
FIG. 2 is an isometric view of an exemplary embodiment of bed frame employing the desired features.

Embodiments shown in the drawings and described herein provide a bed frame for an articulating bed that is an attractive piece of furniture while providing safety benefits for preventing injuries due to collision, pinching and overbalancing. As shown in FIG. 2, the elements of the articulating structure for the bed shown in an upwardly articulated position for all moving elements include a head portion 10, a seat portion 12, a thigh portion 14 and a foot portion 16. The combined articulating structure for supporting a mattress is generally designated 18 for reference. Motion of the articulating elements is achieved as disclosed in either U.S. patent application Ser. No. 12/154,509 filed on May 23, 2008 entitled ADJUSTABLE BED FRAME ASSEMBLY or Ser. No.

12/367,538 filed on Feb. 8, 2009 entitled ARTICULATING BED SYSTEM which are referenced as though fully set forth herein.

Figure 3:
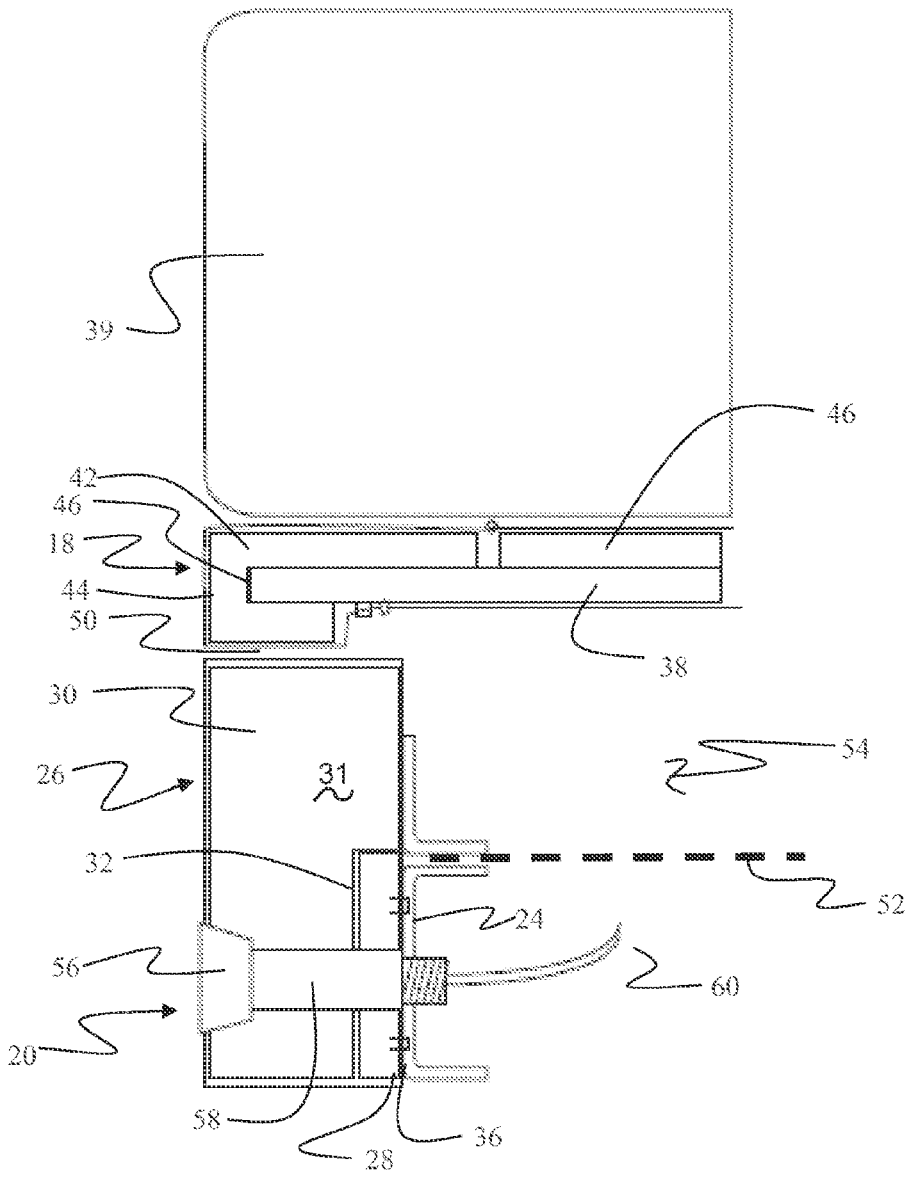
FIG. 3 is a section view of the frame elements.
Figure 4:
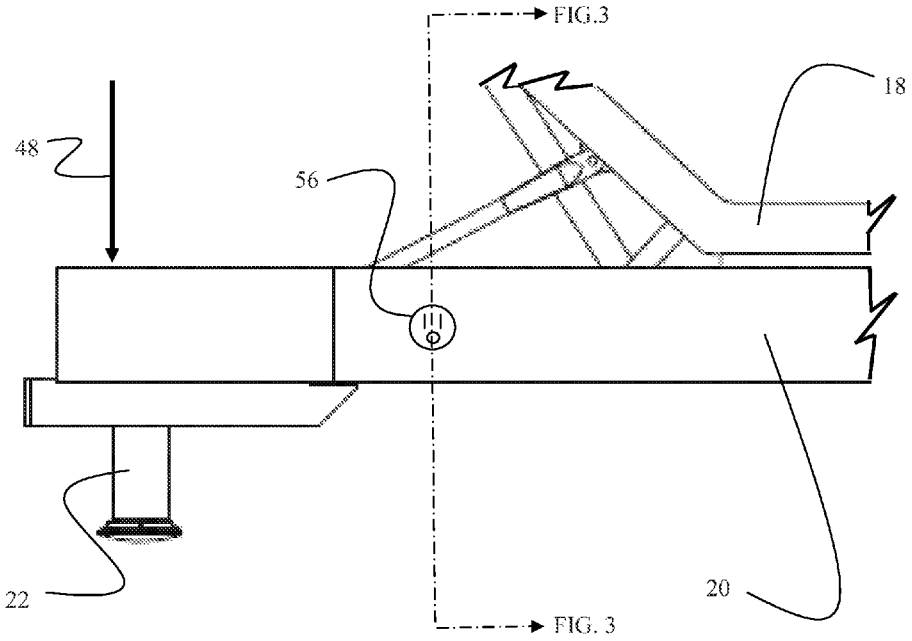
FIG. 4 is a partial side view of the frame head portion.

Support structure 20 provides a base which extends for the entire length of the articulating structure when flat in the unarticulated state. Legs 22 may be located substantially at the extremities of the support structure corners to provide the greatest stability for the entire bed structure. As shown in FIG. 3, the support structure incorporates a rigid structural frame 24 which extends substantially around the perimeter of the bed. Legs 22 are mounted from the structural frame substantially at the corners of the bed. A padded bolster 26 employs a mounting support 28 which attaches to the structural frame. A resilient foam bumper 30 is attached to the mounting support and extends out and up to create a resilient collision protection device and a flexible spacer 31 extending above the frame to the articulating structure as will be described in greater detail subsequently. Placement of the legs 22 for the bed at or near the corners is possible based on the presence of the bumper 30 unlike prior art bed systems which must have a recessed frame to avoid possibly striking the frame with a foot or shin which may be painful. For the embodiment shown the mounting support is of plywood construction and the bumper incorporates a relief 32 to receive the mounting support. A fabric covering 34 surrounds the foam bumper and mounting support and is attached to the mounting support using staples 36 or comparable fastening devices. For the embodiment shown, the fabric covering is an upholstery fabric over an FR mesh which allows the quality furniture appearance for the bed.

The elements of the combined articulating structure 18 are constructed using a plywood or similar material for a rigid planar support 38 for each section of the articulating structure, as described previously, to receive a mattress 39. Edges 40 of the planar support are surrounded with capping 42 of resilient foam which is secured to the planar support using a fabric covering 44 comparable to the covering for the bolster. For exemplary embodiments, polypropylene foam is employed for the bumper and resilient foam capping on the planar support. In alternative embodiments, Polyethylene or other appropriate resilient foam may be employed. For efficiency in production, the bumper and capping may be shaped as extruded foam prior to processing for attachment to the mounting support and edges as will be described in greater detail subsequently. A high density foam layer 46 extends over the planar support between the resilient foam edges to engage and support the mattress.

As shown in FIG. 3, the extension of the support structure 20 to the extent of the articulating structure 18 allows weight bearing stability for forces applied as represented by arrow 48 such as one or more users sitting at the edge of the bed foot or head. Prior bed frames, particularly in the foot portion, were inset to avoid collision with ankles or shins of a user walking around the bed when the foot support portion was articulated upward. Consequently when the foot support portion was flat in the unarticulated position an overhang was present. One or more persons sitting on the overhang could overbalance the bed or undesirably flex the foot support portion.

The bed frame of the present embodiment provides the padded bolster extending outward from the rigid structural frame to avoid any injury from collision with the foot portion 16 articulated upwardly as shown in FIG. 2. The pliable resilient foam bumper 30 absorbs any collision forces. Additionally, the resilient foam bumper extends upwardly from the rigid structural frame elements covering the space between the structural frame and the articulating structural elements in the unarticulated position thereby providing a aesthetically pleasing appearance while additionally providing the ability to flex and avoid pinch injury for any appendage such as an arm, hand or finger which might extend into gap 50 between the articulating structure 18 and the support structure 20 particularly during operation of the articulation mechanisms when the gap may transition from a fairly large dimension with, for example, the foot support portion in the upwardly articulated position, to a close tolerance with the foot support portion fully lowered in the unarticulated position. Deformation of the pliable resilient foam in the bumper will accommodate any intruding appendage.

As shown in FIGS. 2 and 3, the embodiment additionally incorporates a web or mesh 52 which is attached to the structural frame 24 and extends under the articulating structure. This provides a storage cavity 54 which may receive bedding such as sheets or blankets. Also as shown in the drawings, the embodiment includes an AC electrical outlet 56 carried by a housing 58 which penetrates the support frame, mounting support and bumper. Power requirements for the articulating mechanism in the bed allow parallel routing of conductors 60 through the housing to the outlet providing a convenient connection point for beside lamps or other accessories when the wall outlet may be obscured by the head of the bed. Outlets on each side of the bed support structure may be provided.

Figure 5:
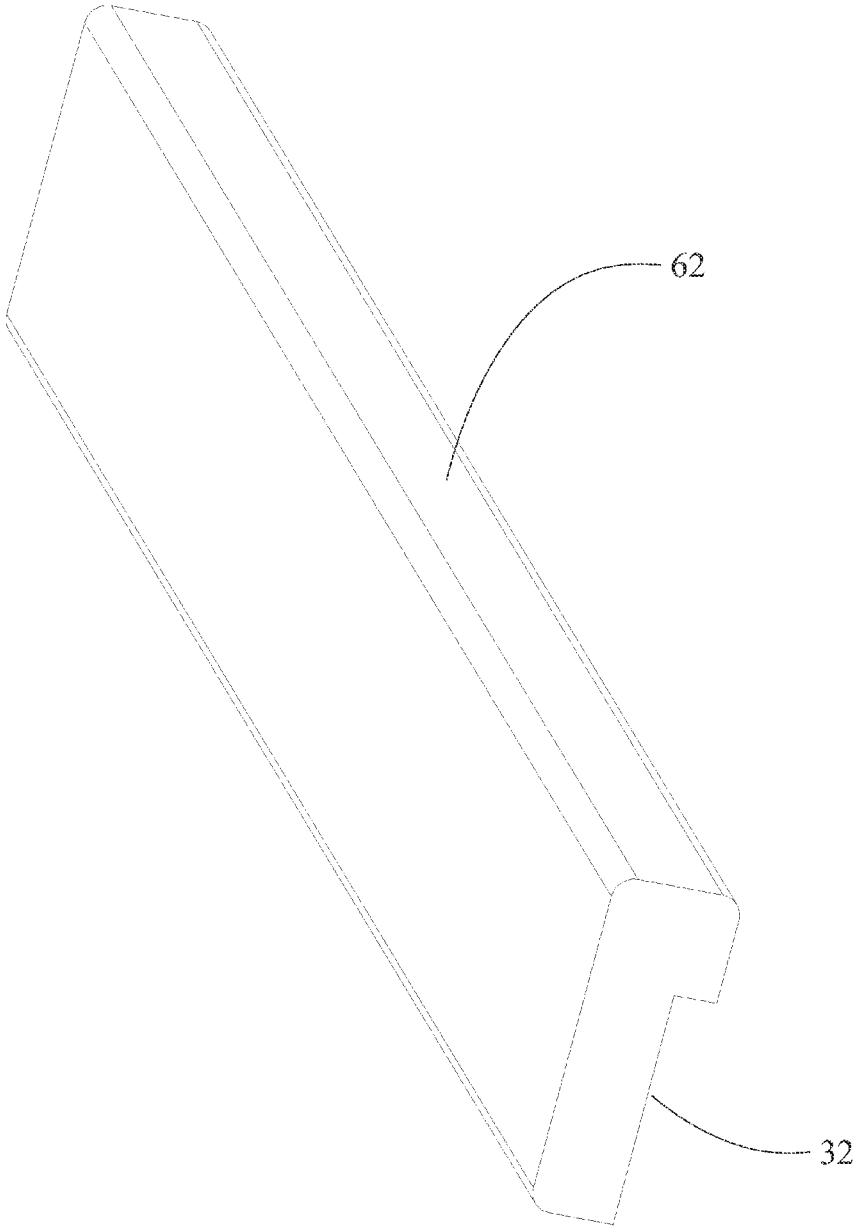
FIG. 5 is an isometric view of an extrusion for the frame foam bumper.
Figure 6:
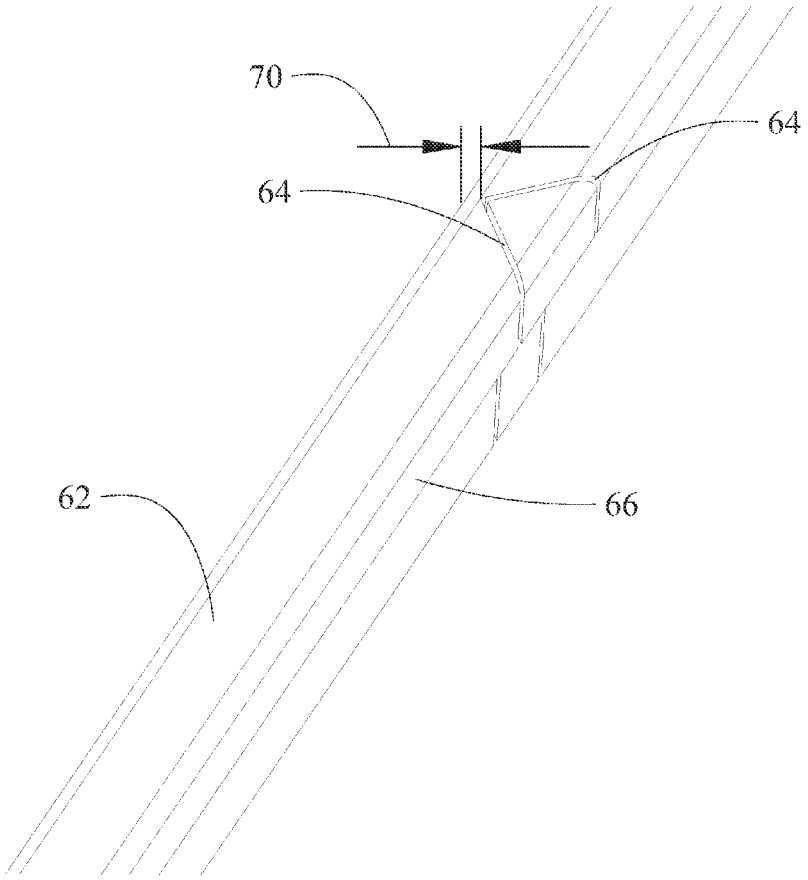
FIG. 6 is a view of the extrusion of FIG. 5 with a cut-out gore for shaping.
Figure 7A:
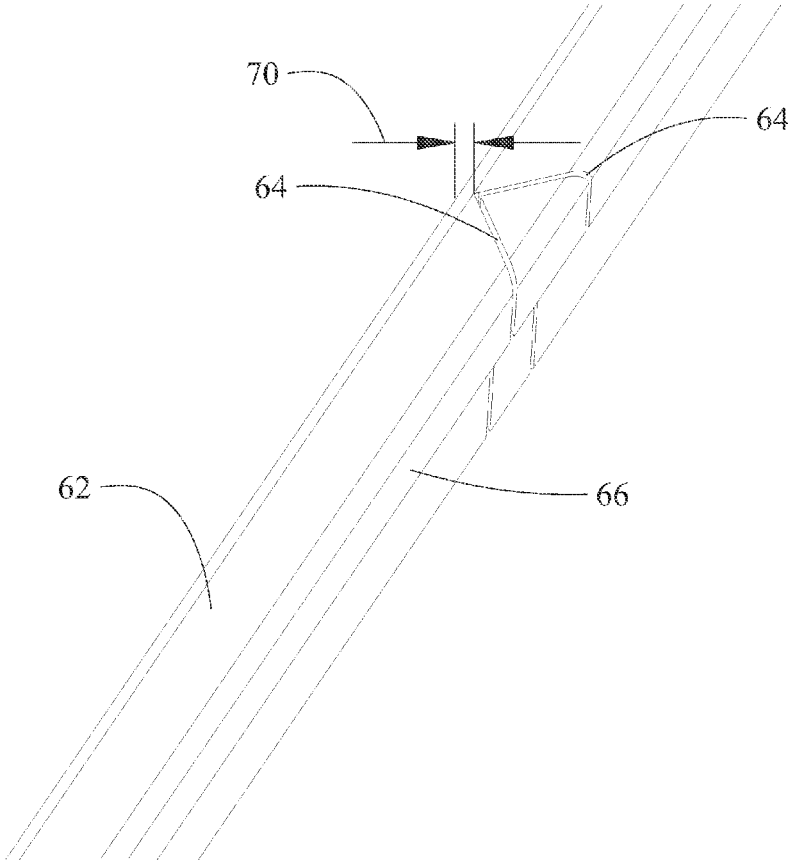
FIG. 7 is a view of the shaped corner with the gore of FIG. 6 removed.
Figure 7B:
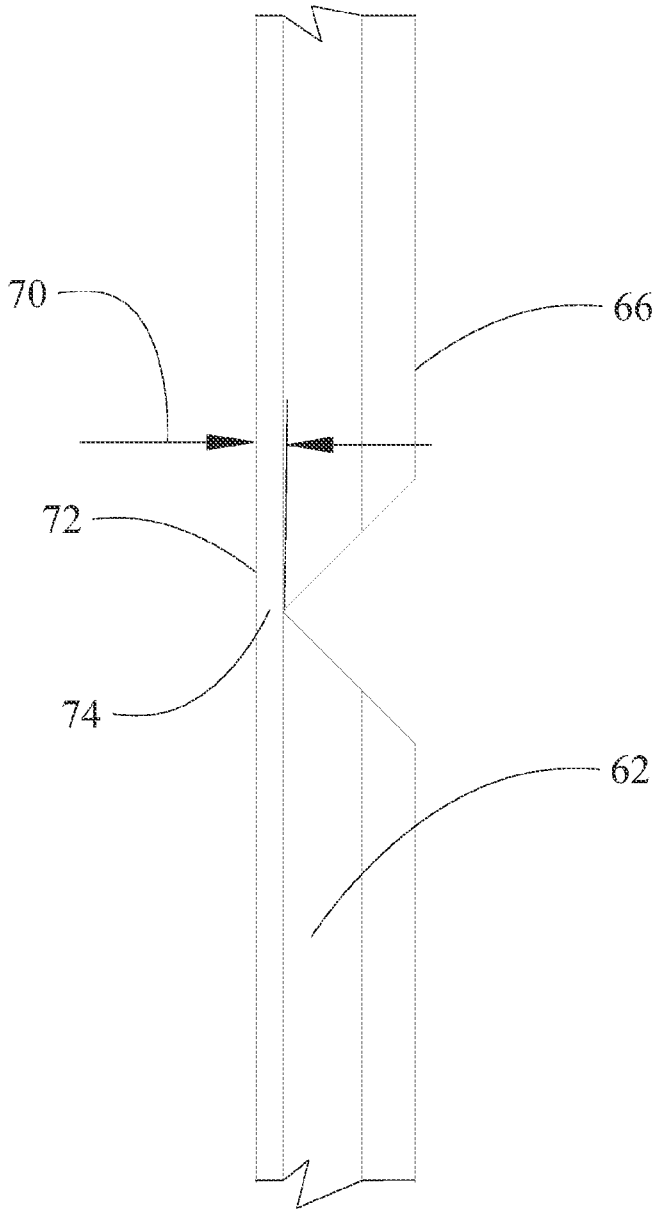
Figure 8:
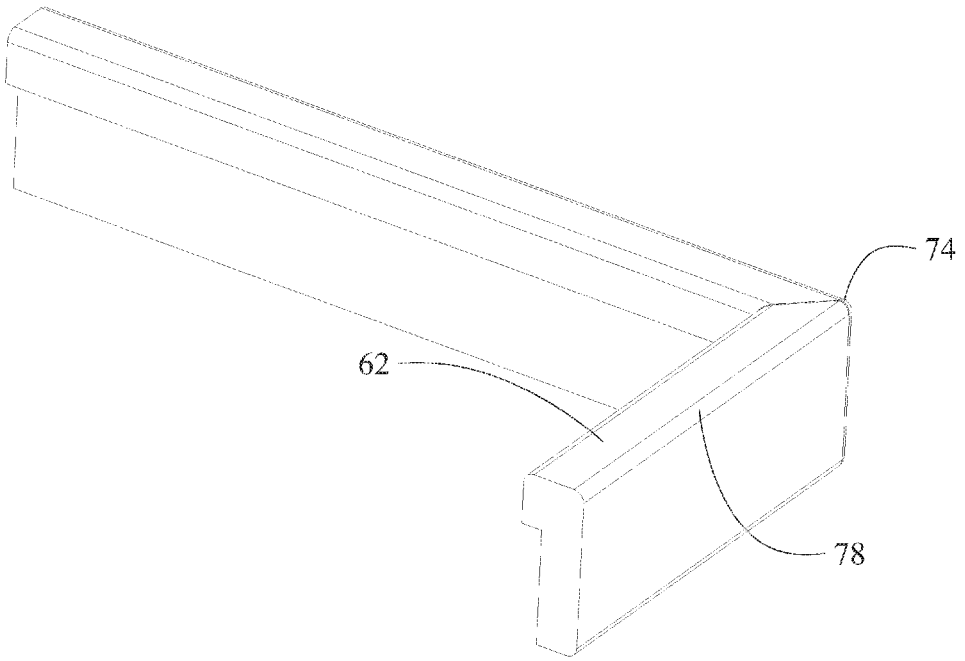
FIG. 8 is a view of the shaped corner after bending.

Fabrication of the bumper 30 and capping 42 is accomplished to provide a smooth exterior surface with continuous rounded edges at all corners. As shown in FIG. 5 for the bumper, the polypropylene foam is extruded in a linear base shape 62 which includes the relief 32 to receive the mounting support as previously described with respect to FIG. 3. To accommodate bending of the based shape at corners of the mounting support, gore cuts 64 as shown in FIG. 6 are made from the inner periphery of 66 the base shape at approximately 45 degree angles to produce a removable gore 68. In the bumper of the exemplary embodiment which has a height of approximately 6 inches and a width of approximately 3 inches, the 45 degree gore cuts terminate at a depth 70 approximately ½ inch from the outer periphery 72 of the base shape. With removal of the gore as shown in FIGS. 7A and 7B, a bendable portion 74 remains in the outer periphery which smoothly flexes to allow deformation of the base shape into a corner as shown in FIG. 8. For the exemplary polypropylene foam, depth 70 is approximately 15 to 25% of the base shape width. Bendable portion 74 assumes a rounded shape with a radius comparable to a blended round chamfer 78 of the base shape edges thereby providing a pleasing symmetrical geometry for the completed bumper. Multiple gore cut locations corresponding to corners in mounting support may be accomplished in a single length of extruded base shape with a single mating joint along one side of the mounting support. Alternatively, lengths of base shape with removed gores may be bent to accommodate one or more corners and then mated to adjacent lengths directly or with intervening straight sections of base shape along the mounting support sides.

Figure 9:
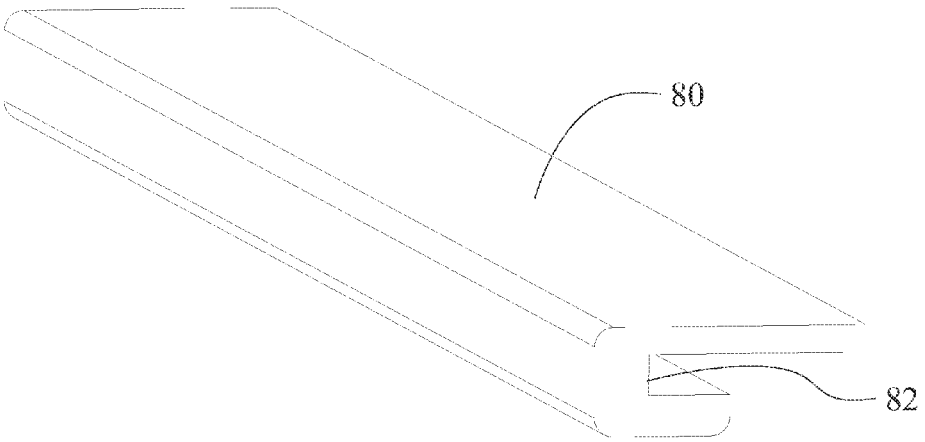
FIG. 9 is an isometric view of an extrusion for the foam capping on the edges of the articulating structure.
Figure 10:
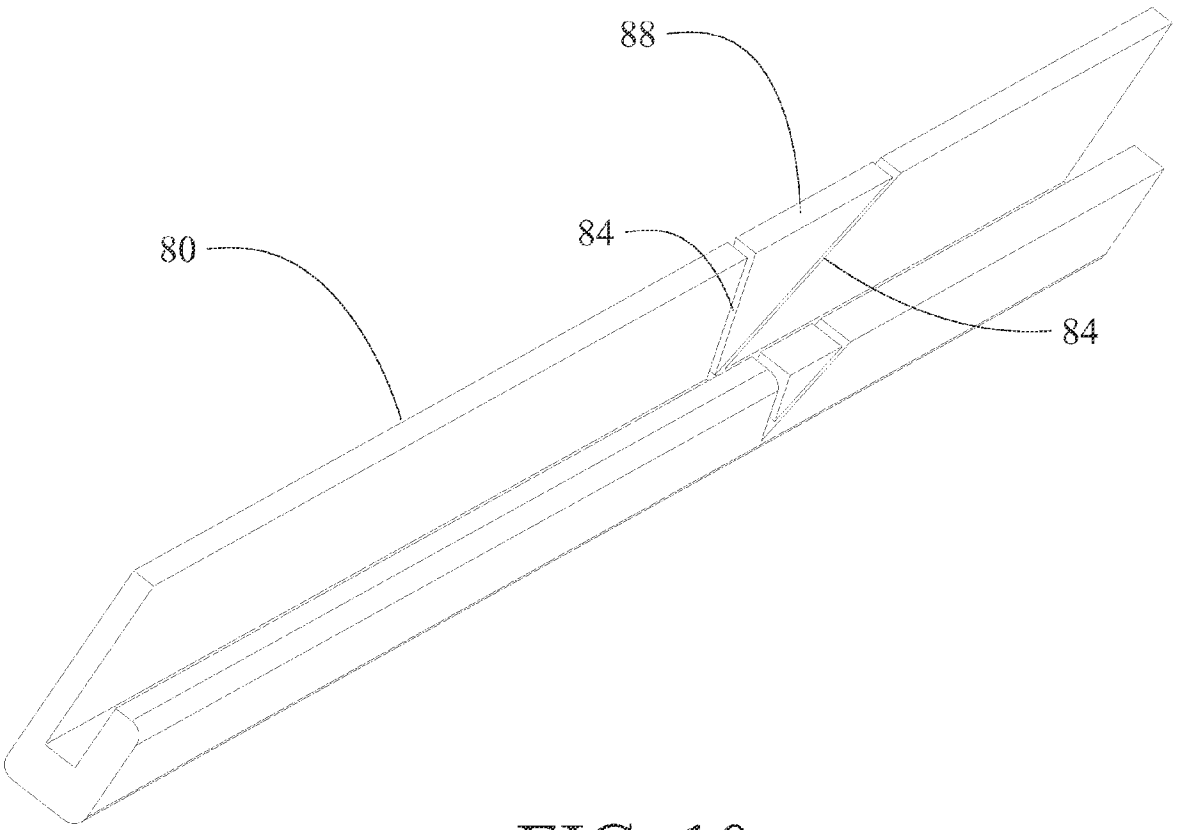
FIG. 10 is a view of the extrusion of FIG. 9 with a cut-out gore for shaping.
Figure 11A:
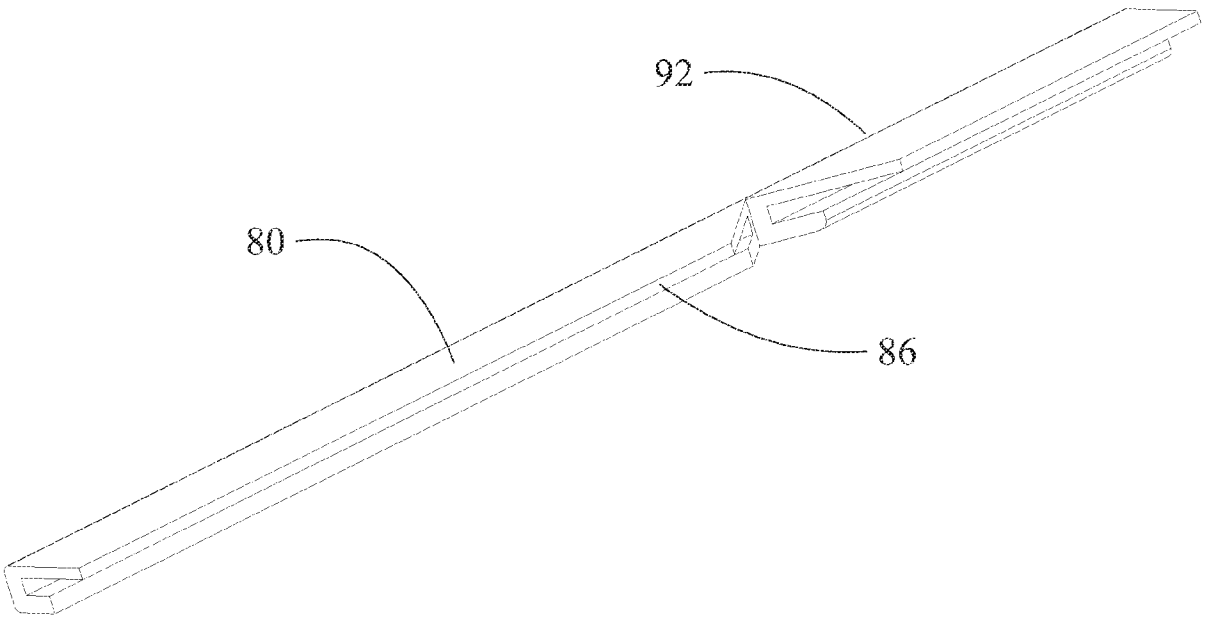
FIG. 11 is a view of the shaped corner with the gore of FIG. 10 removed.
Figure 11B:
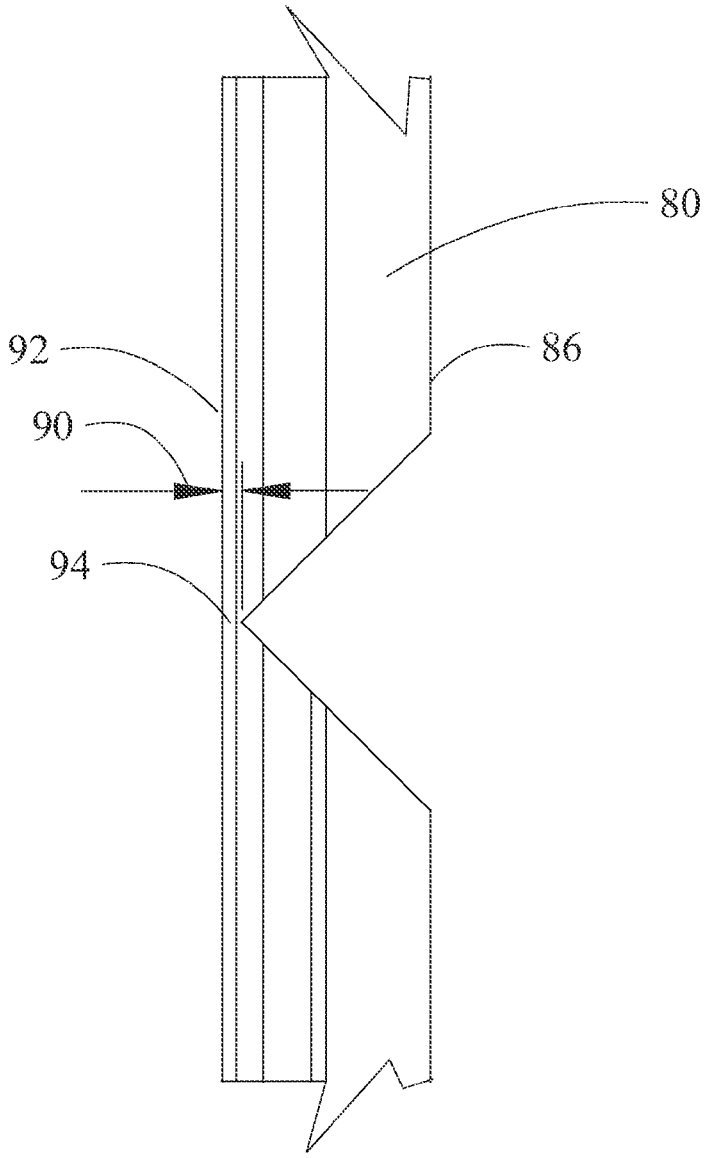
Figure 12:
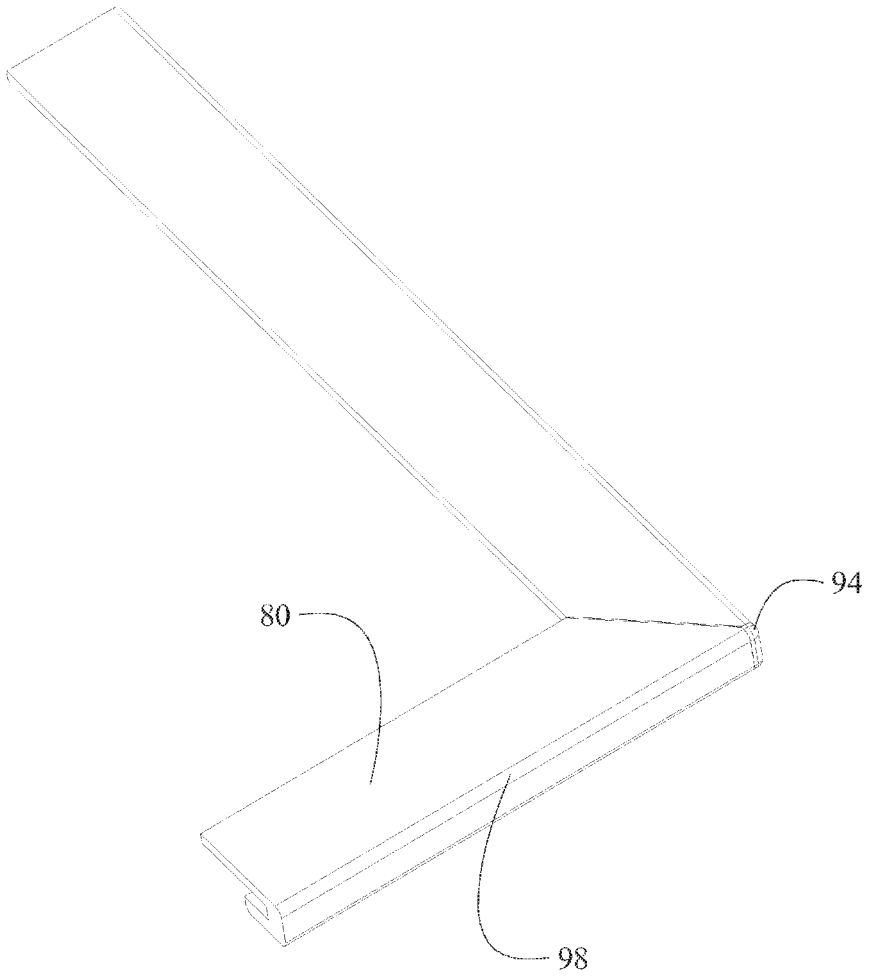
FIG. 12 is a view of the shaped corner after bending.

Similarly, as shown in FIG. 9 for the capping, the polypropylene foam is extruded in a linear capping base shape 80 which includes a relief 82 to receive the planar support edges 40 as previously described with respect to FIG. 3. To accommodate bending of the based shape at corners of the planar support edges, gore cuts 84 as shown in FIG. 10 are made from the inner periphery of 86 the capping base shape at approximately 45 degree angles to produce a removable gore 88. In the capping of the exemplary embodiment which has a height of approximately 2 inches and a width of approximately 3 inches, the 45 degree gore cuts terminate at a depth 90 approximately ½ inch from the outer periphery 92 of the capping base shape. With removal of the gore as shown in FIGS. 11A and 11B, a bendable portion 94 remains in the outer periphery which smoothly flexes to allow deformation of the base shape into a corner as shown in FIG. 12. For the exemplary polypropylene foam, depth 90 is approximately 15 to 25% of the base shape width. Bendable portion 94 assumes a rounded shape with a radius comparable to a blended round chamfer 98 of the capping base shape edges thereby providing a pleasing symmetrical geometry for the completed capping. Multiple gore cut locations corresponding to corners in planar support edges may be accomplished in a single length of extruded base shape. The separations in the planar supports 38 for the sections of the articulating structure 18 may require termination of the capping at each separation to accommodate the angular displacement between sections. For highly flexible resilient foam capping a single mating joint along one side of one planar support edge may be employed. Alternatively, lengths of base shape with removed gores may be bent to accommodate one or more corners and then mated to adjacent lengths directly or with intervening straight sections of capping base shape along the planar support edges.

Figure 13A:
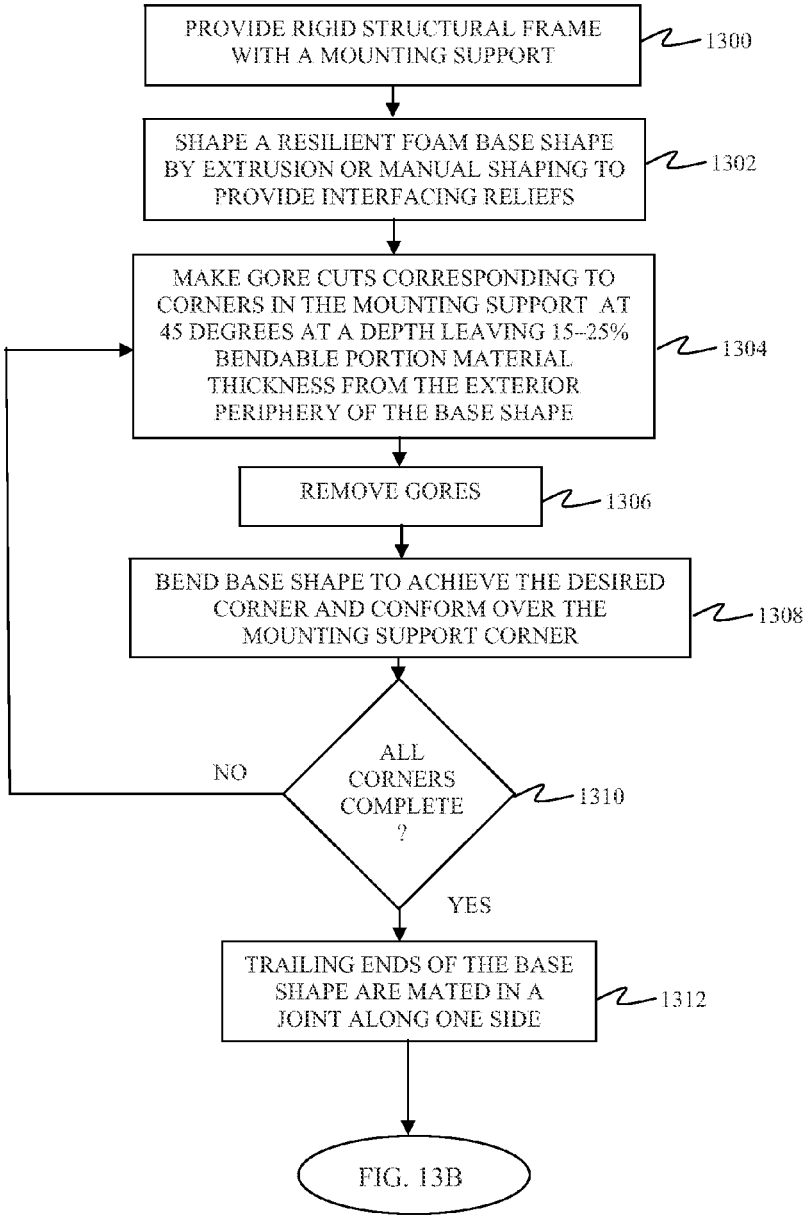
FIGS. 13A and 13B are a flow chart for assembly of the bolster and articulating structure capping.
Figure 13B:
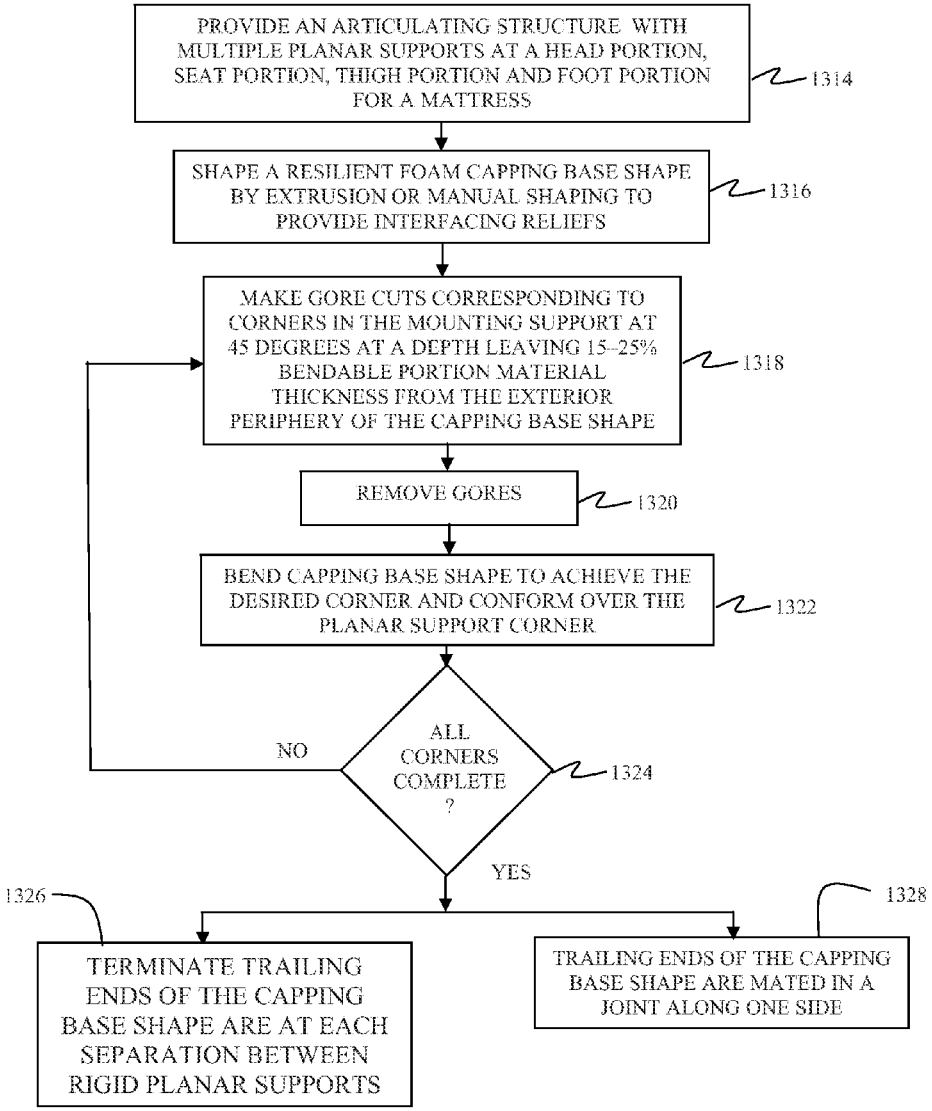

The method for creating the bumper and capping resilient foam elements is shown in FIGS. 13A and B. A rigid structural frame is provided with a mounting support, step 1300. A shaping of a resilient foam base shape is accomplished by extrusion or manual shaping to provide interfacing reliefs, step 1302. Gore cuts corresponding to corners in the mounting support are made at 45 degrees at a depth leaving 15-25% bendable portion material thickness from the exterior periphery of the base shape, step 1304. The gores are removed, step 1306, and the base shape bent to achieve the desired corner and conformed over the mounting support corner, step 1308. This step is repeated for all corners, step 1310, and the trailing ends of the base shape are mated in a joint along one side, step 1312. In alternative embodiments, a straight cut mating joint may be employed or various kerf cuts applied for mating the joining ends.

An articulating structure is provided with multiple planar supports at a head portion, seat portion, thigh portion and foot portion for a mattress, step 1314. A shaping of a resilient foam capping base shape is accomplished by extrusion or manual shaping to provide interfacing reliefs, step 1316. Gore cuts corresponding to corners in the rigid planar supports are made at 45 degrees at a depth leaving 15-25% bendable portion material thickness from the exterior periphery of the capping base shape, step 1318. The gores are removed, step 1320, and the capping base shape bent to achieve the desired corner and conformed over the rigid planar support corner, step 1322. This step is repeated for all corners, step 1324, and the trailing ends of the capping base shape are alternatively terminated at each separation between rigid planar supports in the articulating structure, step 1326 or continuously routed between rigid planar supports and mated in a joint along one side, step 1328. In alternative embodiments, a straight cut mating joint may be employed or various kerf cuts applied for mating the joining ends.

Figure 14:
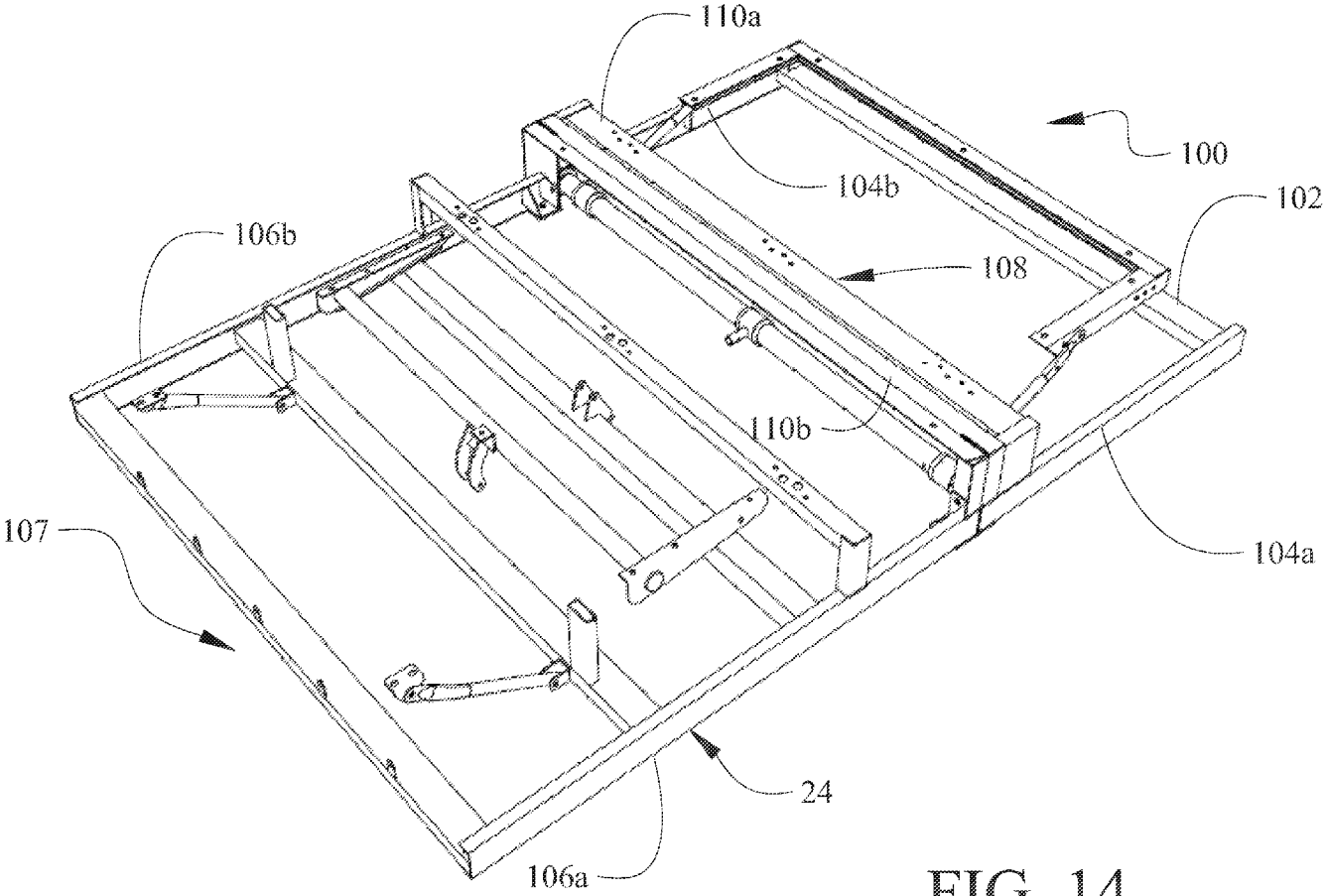
FIG. 14 is an isometric view of a separable structural frame.
Figure 15:
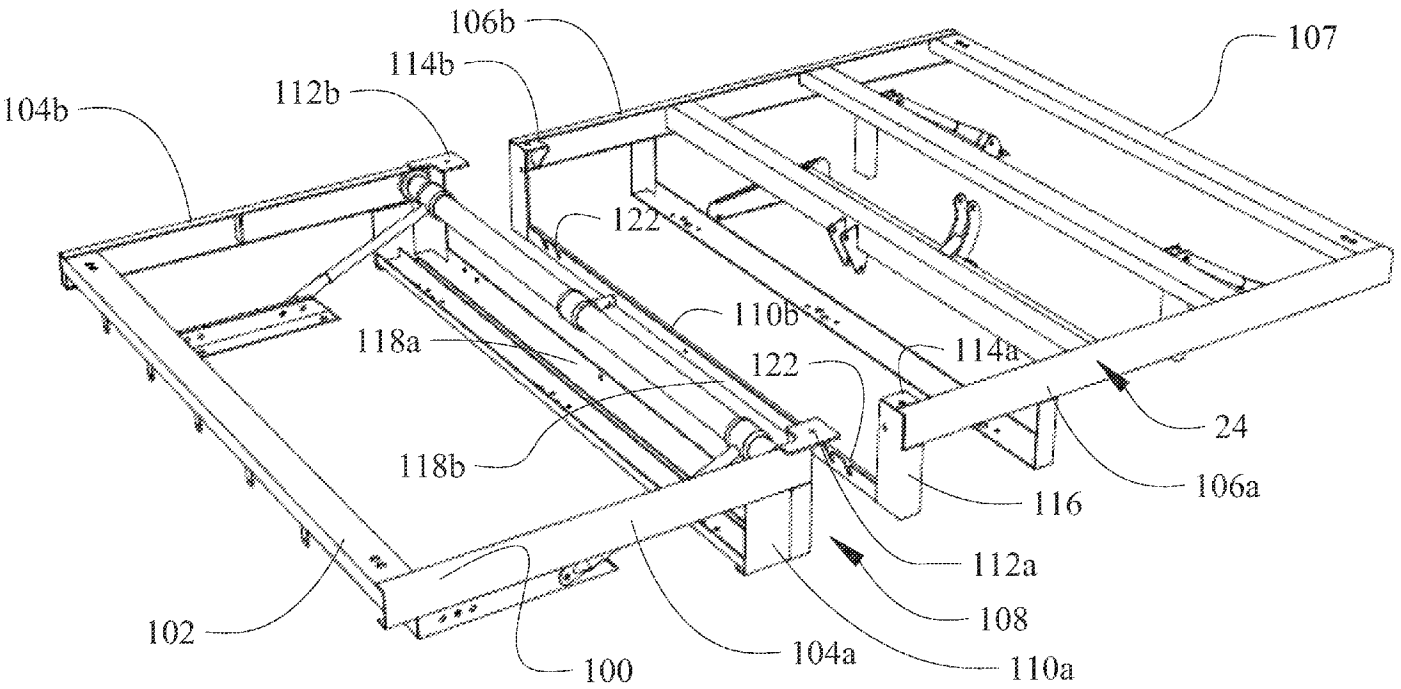
FIG. 15 is an isometric view of the separable structural frame of FIG. 14 in a separated condition with the elements inverted.
Figure 16:
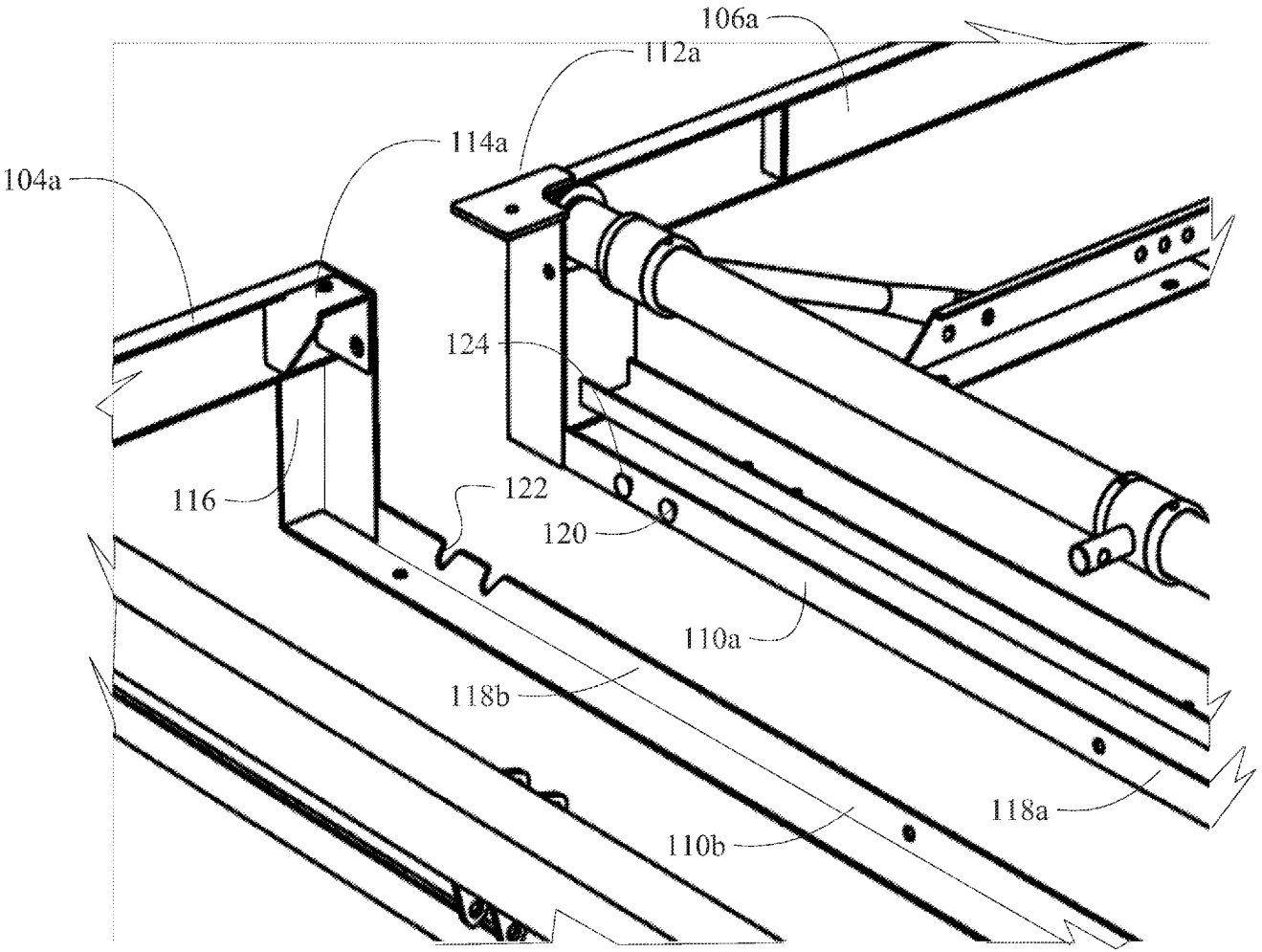
FIG. 16 is an isometric view of the details of the joining elements for the separatable structural frame of FIG. 14.

To accommodate the requirements for installation of articulating beds employing the features of the embodiments described, FIGS. 14, 15 and 16 demonstrate a separable structural frame 24 which incorporates a head portion 100 having a head rail 102 and side section rails 104*a* and 104*b* which are separable from side main section rails 106*a* and 106*b* in a main portion 107 of the bed structure. A connection arch 108 spans the side section rails and side main section rails to provide torsional support for the sections in both the assembled (as shown in FIG. 14) and disassembled condition (as shown in FIG. 15). The connection arch has a head section portion 110*a* and a main section portion 110*b* which are interconnected to the side section rails 104*a* and 104*b* and side main section rails 106*a* and 106*b* respectively.

For the embodiment shown, engagement between the separable head section and main section of the structural frame is accomplished with engaging receiving flanges 112*a* and 112*b* mounted to bottom surface of the head side section rails 104*a* and 104*b* respectively with receiving brackets 114*a* and 114*b* adjacent a bottom surface of the main side section rails 106*a* and 106*b* respectively. Channels 116 support the head section portion 110*a* of the arch interface and support the receiving brackets to engage the receiving flanges. End flanges 118*a* and 118*b* depending from main section portions of the arch 110*a* and 110*b* allow securing of the two sections with bolts 120 or other removable/adjustable fasteners. Angularly slotted receiving holes 122 engage extended heads 124 of bolts 120 to allow engagement of the arch head section portion and main section portion by sliding angular engagement prior to fastening of the receiving brackets on the bottom surfaces 118 of the channels 114. The head side section head rail and side section rails and the side main section rails provide vertical surfaces for direct attachment of the mounting support 28 of the padded bolster 26 as previously described.

Removal of the fasteners and separation of the main section and head section allows a reduction in overall length of the rigid structural frame to allow individual insertion of those sections into a smaller room within a residence having reduced door size or other clearance issues. The receiving brackets and interconnected depending end flanges in combination with the arch provides structural rigidity comparable to a non-separable bed frame thereby allowing the articulating elements of the bed to operate correctly without binding or other issues after assembly.

Arch 108 provides torsional rigidity for the assembled and, with head portion and main portion separable, the separated sections of the structure and may additionally provide attachment for a seat portion rigid planar support for an articulating structure as defined in copending application Ser. No. 12/367,538 filed on Feb. 8, 2009 entitled ARTICULATING BED SYSTEM.

Having now described various embodiments of the invention in detail as required by the patent statutes, those skilled in the art will recognize modifications and substitutions to the specific embodiments disclosed herein. Such modifications are within the scope and intent of the present invention as defined in the following claims.

What is claimed is:

1. A bed frame for an articulating bed comprising:

a support structure incorporating a rigid structural frame for carrying an articulating structure, said support structure extending substantially to the extents of the articulating structure in an unarticulated position;

a padded bolster with a mounting support attached to the rigid structural frame and a resilient foam bumper received on the mounting support and extending outwardly and upwardly from the mounting support and the rigid structural frame with a fabric covering surrounding the bumper and fastened to the mounting support, said foam bumper including a flexible spacer extending above the rigid structural frame, the flexible spacer contacting the articulating structure in an unarticulated position.

2. The bed frame as defined in claim 1 wherein the articulating structure includes rigid planar supports having edges and further comprising a resilient foam capping surrounding the edges of the planar supports and a fabric covering surrounding the foam layer and secured to the planar support.

3. The bed frame as defined in claim 2 wherein the foam bumper and foam capping are selected from the set of polyethylene or polypropylene extruded foam.

4. The bed frame as defined in claim 2 wherein the foam capping comprises extruded foam capping base shape with gore cutouts for resilient bending of corners to match corners of the rigid planar supports of the articulating structure.

5. The bed frame as defined in claim 4 wherein the gore cutouts provide a bendable portion having a thickness adapted to provide a desired curvature.

6. The bed frame as defined in claim 5 wherein the bendable portion has a thickness of about 15% to 25% of a capping base shape thickness.

7. The bed frame as defined in claim 1 further comprising a web extending from the structural frame forming a cavity intermediate the padded bolster and planar supports, said cavity accessible with the articulating structure in an articulated position.

8. The bed frame as defined in claim 1 further comprising an electrical outlet on the padded bolster.

9. The bed frame as defined in claim 8 wherein the electrical outlet is mounted in a housing which penetrates the support frame, mounting support and bumper.

10. The bed frame as defined in claim 1 wherein at least the flexible spacer of the padded bolster is resiliently deformable.

11. The bed frame as defined in claim 1 wherein the foam bumper comprises an extruded foam base shape with gore cutouts for resilient bending of corners to match corners of the mounting support.

12. The bed frame as defined in claim 11 wherein the gore cutouts provide a bendable portion having a thickness adapted to provide a desired curvature.

13. The bed frame as defined in claim 12 wherein the bendable portion has a thickness of about 15% to 25% of a base shape thickness.

14. The bed frame as defined in claim 1 wherein the rigid structural frame is separable and incorporates a head portion having a head rail and side section rails which are separable from side main section rails in a main portion of the structural frame;

a connection arch spanning the side section rails and side main section rails to provide torsional support for the sections in both an assembled and disassembled condition, the connection arch having a head section portion and a main section portion which are interconnected to the side section rails and side main section rails respectively.

15. The bed frame as defined in claim 14 further comprising:

receiving brackets engaging recessed bottom surfaces of channels mounted to the arch head portion;

end flanges depending from the head section portion of the arch and main section portion of the arch;

removable fasteners securing the end flanges.

16. A protective bed frame comprising:

a support structure having a rigid structural frame for carrying an articulating structure for an adjustable bed, said support structure extending substantially to the extents of the articulating structure in an unarticulated position and having a padded bolster including a mounting support attached to said rigid structural frame and a resilient foam bumper received on the mounting support with a fabric covering surrounding the bumper and fastened to the mounting support, said foam bumper including a flexible spacer extending above the rigid structural frame, the flexible spacer contacting the articulating structure in an unarticulated position;

the articulating structure including rigid planar supports having edges and a resilient foam layer surrounding the edges of the planar supports and a fabric covering surrounding the foam layer and secured to the planar support, said flexible spacer of the bumper and foam layer resilient to deform upon contact with an intruding appendage inserted therebetween; and, an electrical outlet mounted in a housing which penetrates the support frame, mounting support and bumper.

* * * * *